US006229876B1

(12) United States Patent
Enck et al.

(10) Patent No.: US 6,229,876 B1
(45) Date of Patent: May 8, 2001

(54) X-RAY TUBE

(75) Inventors: Richard S. Enck, San Jose; Richard G. Johnson, Scotts Valley, both of CA (US)

(73) Assignee: Kevex X-Ray, Inc., Scotts Valley, CA (US)

( * ) Notice: Subject to any disclaimer, the term of this patent is extended or adjusted under 35 U.S.C. 154(b) by 0 days.

(21) Appl. No.: 09/363,777

(22) Filed: Jul. 29, 1999

(51) Int. Cl.[7] ..... H01J 35/06
(52) U.S. Cl. ..... 378/136; 378/119; 378/121
(58) Field of Search ..... 378/119, 121, 378/122, 136

(56) References Cited

U.S. PATENT DOCUMENTS 5,751,784 * 5/1998 Enck ..... 378/140

* cited by examiner

*Primary Examiner*—Robert H. Kim
*Assistant Examiner*—Allen C. Ho
(74) *Attorney, Agent, or Firm*—William J. Benman

(57) ABSTRACT

An x-ray tube comprising an electron gun assembly having an electron gun container housing an electron generator for generating electrons in a first direction along a first axis. The beam of electrons impinges upon an anode which emits x-rays in response to the beam of electrons. The gun container is characterized by having a discharge end comprising a solid spherical shape.

20 Claims, 5 Drawing Sheets

X-RAY TUBE

BACKGROUND OF THE INVENTION

1. Field of the Invention

The present invention relates to an x-ray tube. More specifically, the present invention relates to an x-ray tube configuration capable of generating high intensity x-rays that emanate from a small focal spot without a loss of reliability.

2. Description of the Related Art

X-ray tubes have a number of applications which involve the treatment or analysis of a sample, for example, industrial imaging, analytical instruments and medical imaging. For such applications, it is often desirable to have an x-ray tube which has a long service life, which is capable of forming a small focal spot and which is also capable of generating a high intensity of x-radiation at the sample.

X-ray tubes generally include an electron gun and an anode. A beam of electrons generated by the electron gun is focused to a focal spot on the anode, and x-rays are generated by the interaction of the beam of electrons with the atoms of the anode. These x-rays are generated in all directions emitting from the anode in the region surrounding the focal spot. Typically, the anode is substantially surrounded by an evacuated housing in which a window is formed to permit some of the x-rays to pass out of the housing, the window typically comprising a thin foil of a low atomic number metal, such as beryllium or aluminum, having a high transmission coefficient for x-radiation. Illustrative prior art x-ray tube structures in this regard are described, for example, in U.S. Pat. Nos. 5,751,784 and 5,563,923.

A commercially available x-ray tube 1 is schematically illustrated in FIG. 1 which employs a gun container 2 having a flat surfaced discharge end 3, i.e., gun snout, relative to the electron beam direction x, and x-rays emitted from anode 4 pass through an x-ray transmissive window 5 formed in a side of the hermetically sealed and evacuated envelope 6. The gun container 2 houses a cathode and filamentary heater used to generate an electron beam in a generally known manner. The gun snout 3 is flat in the sense it is a planar surface oriented perpendiculary to the beam direction x with a central aperture (not shown in the view) for transmission of the electron beam out of the gun container 2. Using the flat surfaced discharge end 3, focal spot sizes are yielded on the anode 4 (i.e., target) which tend to be relatively large, e.g., exceeding 20 microns in largest diameter, and which tend to be heavily limited by chromatic aberration. One approach to reducing the spot size is to reduce the working distance between the gun snout and anode. Smaller working distances produce smaller magnification for the beam; hence, a smaller spot at the anode. However, investigations conducted by the present inventors have shown that a flat gun snout tends to produce high field emission and instability when positioned nearer a target due to high electric fields. Consequently, such x-ray tubes with flat gun container snouts are focus limited due to chromatic aberration and instability issues, especially if attempts are made to position the gun assembly in closer proximity to the target.

It would be desirable to be able to position a gun snout in very close proximity to the target in order to reduce beam size and provide small spot focusing yet without unduly increasing the structural or operational complexity of the x-ray tube. An object of this invention is to provide an x-ray tube endowed with enhanced electron beam focusing performance and capabilities, and, more particularly, provide an x-ray tube with an electron gun positionable in close proximity to the target at reduced surface fields to achieve smaller focal spots without incurring instability.

SUMMARY OF THE INVENTION

According to the present invention, an x-ray tube is provided having an electron gun container having a spherical shaped snout for discharging electrons from the gun container towards an anode (target) where x-rays are generated.

More particularly, in one embodiment of this invention, there is an x-ray tube including:

an electron gun assembly comprising an electron gun container housing an electron generator for generating electrons in a first direction along a first axis, where the gun container has a gun snout with an egress aperture through which the electrons are discharged from the gun container; and a target for generating x-rays upon being impinged by the electrons that are discharged from the gun snout;

and in which the gun snout of the x-ray tube is characterized by having a solid spherical shape.

The spherical surface of the gun snout has its concave (inner) side facing the electron generating means within the gun container and its convex (outer) side facing the anode (target) located outside the gun container. For purposes of this application, the term "spherical" refers to a gun snout having a surface profile all points of which are substantial equidistant from a common imaginary center of radius located inside the gun container, i.e. comprises a substantially constant radius of curvature. Thus, the edge profile of the spherical snout of the invention is curvilinear, and not a straight line such as would be the case with a conical shape. As a matter of course, the gun snout will be semi-spherical, as it does not form a complete sphere. Preferably, the spherical surface is arranged such the electron beam passes through the geometric center of the space defined within the solid spherical surface before exiting from the snout aperture. The spherical surface preferably has a decreasing cross-sectional diameter in the direction of the electron beam towards the exit aperture of the snout. In this way, the spherical gun snout presents an overall "lens" profile. The gun snout preferably is a substantially hemispherical dome-shape with the gun container having a separate cylindrical portion merged with the dome to form an overall tubular-shaped gun container with a rounded, aperture tip for discharging the electron beam towards the anode (target).

Advantageously, the x-ray tube also includes at least one accelerating electrode to provide a focus grid through which the electrons pass before reaching the snout situated within the gun container at a location between the electron generating means (e.g. a heated cathode), and the egress aperture of the gun snout of the gun container. The focus grid includes a central opening through which the electrons pass and accelerates the electrons emitted by the cathode and converges the electrons into an electron beam along the first axis. A separate electrode situated between the cathode and the focus electrode functions to control the beam current.

The inventive x-ray tube, as equipped with such a spherical discharge snout on the gun container, enhances the electron beam focusing capability of the x-ray tube. The inventive x-ray tube with the spherical gun can be operated in a highly stable manner with beam diameters generated at the x-ray target of relatively small dimension, e.g., less than approximately 10 micron focal spot sizes in largest dimension. The spherical shape provides the lowest possible surface field on the snout, thereby reducing field emission, even at very close distances and high field conditions. The inventive spherical gun snout configuration enables the closest possible spacing and approach of the electron gun to the high electric fields of the target (anode) without suffering focus aberration.

BRIEF DESCRIPTION OF THE DRAWINGS

An example of the invention will now be described in greater detail with reference to the accompanying drawings, which are provided by means of example only and in which.

Figure 1:
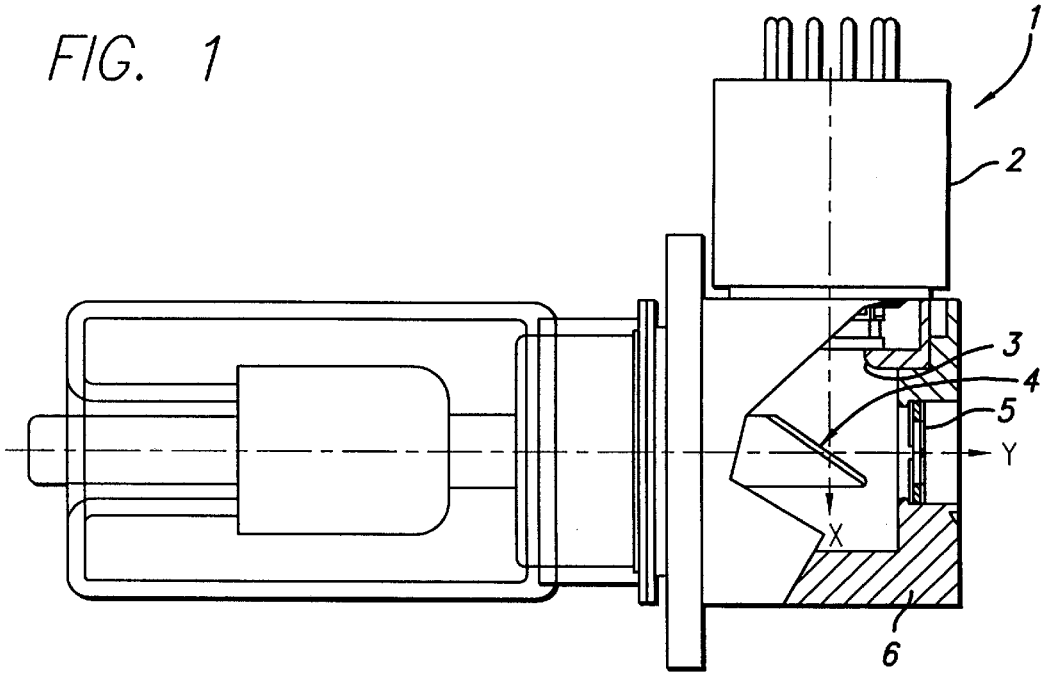
FIG. 1 is a sectional view of a commercially available x-ray tube having a flat gun snout.

It will be understood that the drawing is merely provided for illustrative purposes and that the depicted features are not necessarily drawn to scale. The same referencing numbering is employed throughout the various figures to designate the same features.

DESCRIPTION OF THE INVENTION

Illustrative embodiments and exemplary applications will now be described with reference to the accompanying drawings to disclose the advantageous teachings of the present invention.

While the present invention is described herein with reference to illustrative embodiments for particular applications, it should be understood that the invention is not limited thereto. Those having ordinary skill in the art and access to the teachings provided herein will recognize additional modifications, applications, and embodiments within the scope thereof and additional fields in which the present invention would be of significant utility.

Figure 2:
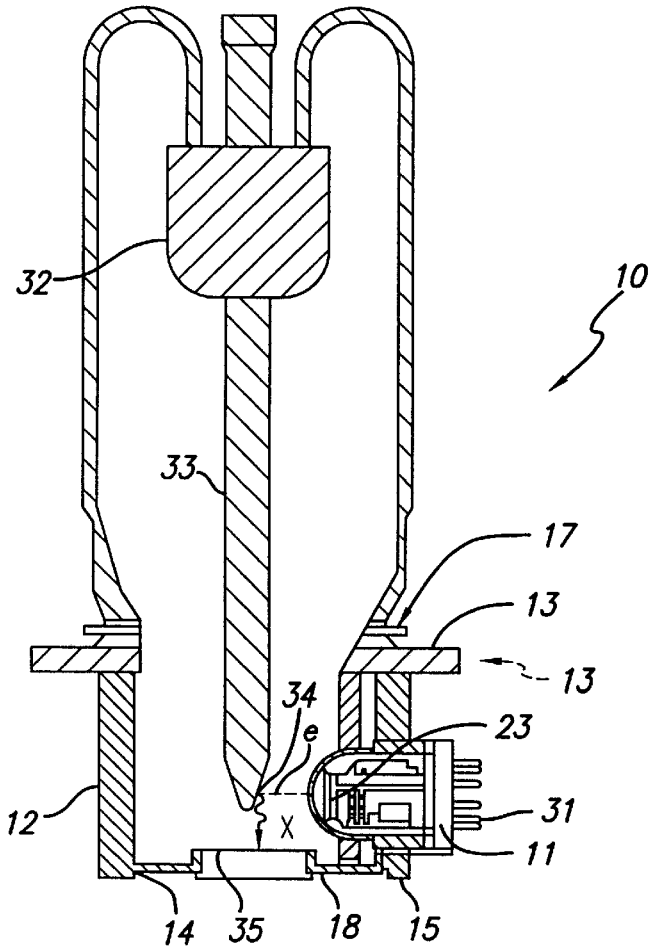
FIG. 2 is a sectional view of an assembled x-ray tube of an embodiment of the invention.

FIG. 2 illustrates an x-ray tube generally indicated by 10 comprising an anode 34 and a means for generating a beam of electrons. The electron gun assembly 11 and the anode 34 are both disposed inside an air evacuated housing or envelope body 12 including an x-ray transparent window 35. The electron gun assembly 11 is provided with electrical connectors 31 for the supply of power to the electron gun assembly 11. The target assembly 33, the electron gun assembly 11, and the window 35 are each welded to the envelope body 12 to provide air-tight seals. The beam current can range from a few microamps up to several milliamps. The electron emission source can be a dispenser type button cathode indirectly heated by a filament assembly. The focus grid electrodes 23 disposed between a cathode 36 (see FIG. 10) and an egress aperture 26 in gun container 11, a plurality of which are used in the present invention, e.g., four, serve to accelerate electrons emitted from a cathode 36 in the gun container 11 while converging the electrons to produce an electron beam. The cathode 36, egress aperture 26 of the spherical snout 27, and the accelerating grid electrodes $\mathbf{23}_1$–$\mathbf{23}_4$, of the gun container 11 are indicated more clearly in FIG. 10. The grid electrodes $\mathbf{23}_1$–$\mathbf{23}_4$, converge the electrons generated by the cathode 36 into an electron beam e along a first axis. The grid electrode $\mathbf{23}_1$ also functions to control the beam current.

Figure 9A:
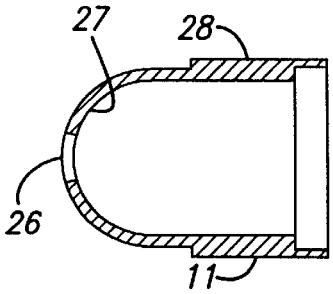
FIG. 9A is an isolated sectional side view of the gun container with a spherical snout which is used in the x-ray tube of the invention.
Figure 9B:
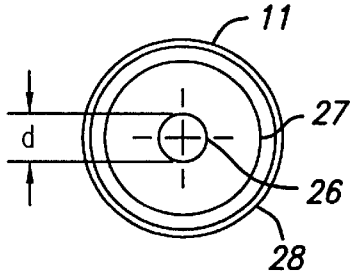
FIG. 9B is an isolated section end view of the gun container with a spherical snout which is used in the x-ray tube of the invention.

The beam of electrons e is accelerated toward the anode 34 by the potential difference established between the focus grid electrodes 23 of the gun assembly 11 and the target assembly (electrode) 33, and, in route, passes through a circular aperture 26 in the spherical gun snout 27 (see FIG. 9B). The beam of electrons e generated by the electron gun assembly 23 has a potential typically between approximately −25 to −130 kV relative to the target assembly on exiting the electron gun 23 assembly. The target assembly 33 is coated on a lower inclined flat surface with a layer of tungsten (not shown) 34, or other suitable material for generating x-rays upon electron beam exposure such as copper or molybdenum In one embodiment, the target angle is approximately 24 degrees from the plane of the target surface 34 relative to a direction (c—c) perpendicular to the window 35. The x-rays x are generated in a range of directions from the anode 34 in the region surrounding the focal spot. X-rays x having a take-off angle at approximately a right angle to the electron beam e pass through window 35. The beam of electrons e forms a focal spot having a diameter less than 10 $\mu$m, and as small as approximately 5 $\mu$m. The window 35 comprises a sheet of transparent x-ray transmissive material, such as beryllium (e.g., about 15 mm in diameter and about 0.13 mm thick). The position and dimension of the aperture 26 in the gun container 11 enables use of the x-ray tube 10 for imaging applications in which a high resolution and high x-ray flux is required. The high resolution is achievable because the small size of the focal spot. The envelope body 12 is preferably a conventional sealed metal-glass type.

Figure 11:
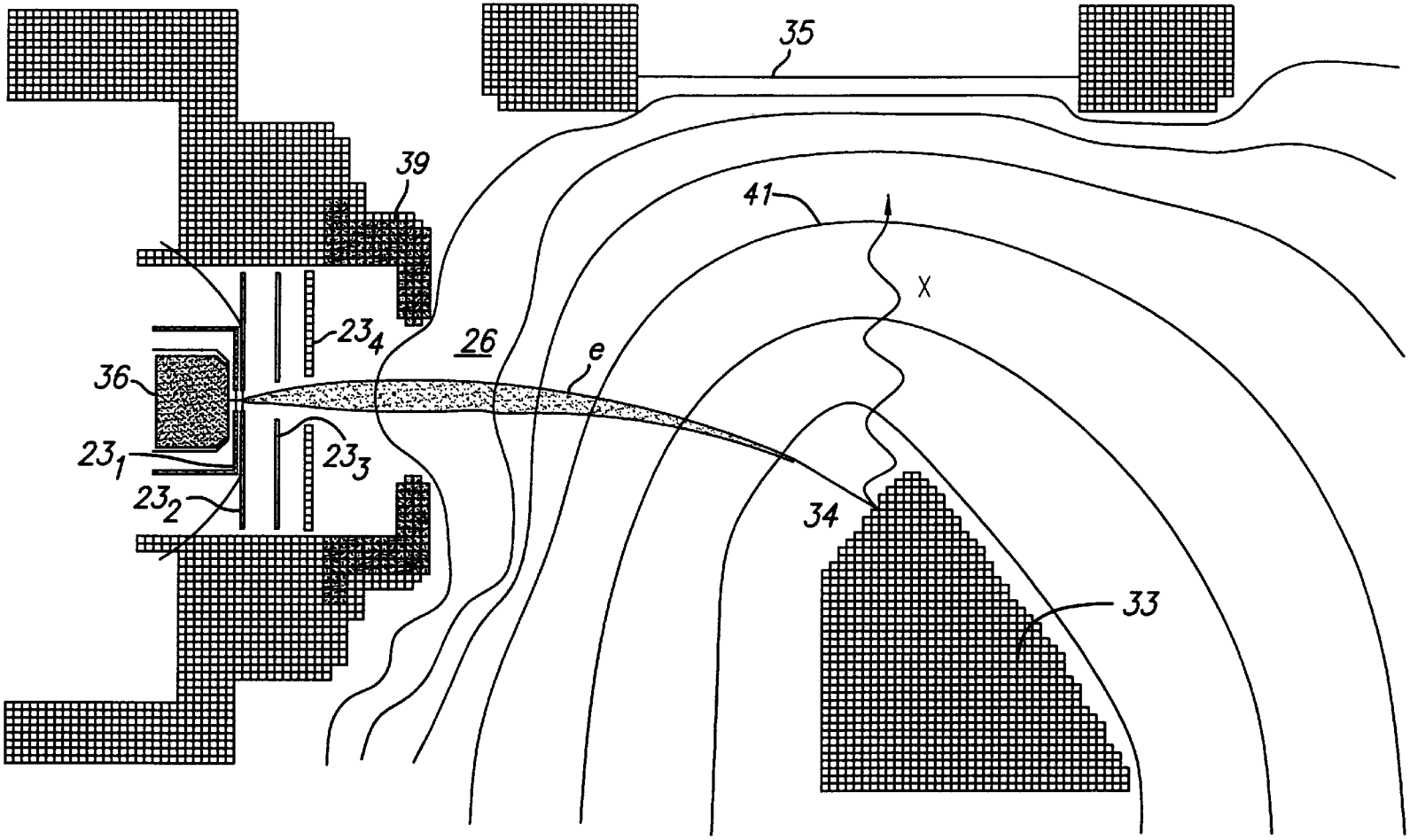
FIG. 11 is a graphical illustration of a comparative x-ray tube in which a gun container is used having a snout with a stepped configuration based on a computer simulation.

An important aspect of the present invention is that the gun container 11 has a spherical snout 27, and it is shown in more detail in FIGS. 9A–B. The snout has circular aperture 26, and the gun container 11 also has a cylindrical section 28 that merges with the spherical snout 27. The importance of the spherical shaped snout, as compared to other geometries, has been confirmed. Namely, other snout configurations were comparatively examined against the inventive spherical gun snout, but the comparative configurations were found to suffer from chromatic aberrations and instability due to field emission problems. For instance, a flat gun snout design discussed previously relative FIG. 1 was found to produce a 25 $\mu$m focal spot and it was severely focus limited due to chromatic aberration. Designs using a conical snout improved focusing but were found to be unstable due to field emission. This same problem was observed for a stepped, re-entrant gun snout 39 design having a shape as illustrated in FIG. 11. That is, a stepped gun snout configuration also was constructed and tested and it had a close working distance capable of achieving a highly focused spot, e.g., about 6 $\mu$m, and which was generally less limited in chromatic aberration than the flat gun snout design. However, the re-entrant refined gun snout had relatively higher electrical surface fields on the gun snout than the inventive spherical gun design for the same gun/snout aperture size. None of the comparative flat, conical or stepped gun snout configurations could achieve the small spot focus and high voltage stability of the inventive spherical gun snout design.

Figure 10:
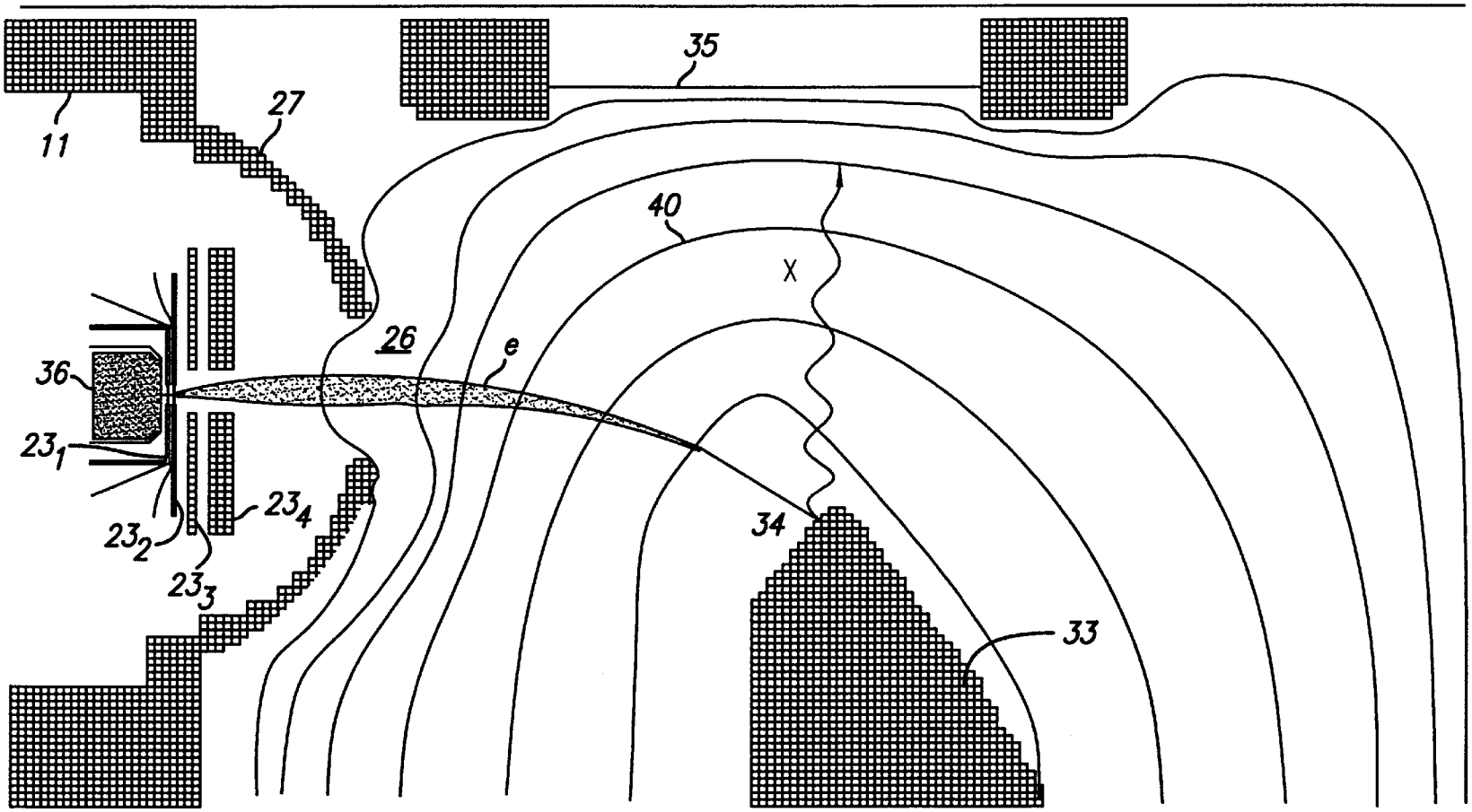
FIG. 10 is a graphical illustration of a portion of an x-ray tube in which a gun container is used having a snout with a spherical configuration according to the invention based on a computer simulation.

Based on computer simulations conducted with commercially available software, the highest electric field point associated with the inventive spherical gun snout (FIG. 10) was reduced to 7700 volts/mil, which is significantly superior to the 11,800 volts/mil found for the re-entrant stepped snout design (FIG. 11). FIG. 10 shows the equipotential field lines or surfaces 40 associated with the spherical snout design, while FIG. 11 shows the equipotential field lines or surfaces 41 associated with the comparative stepped snout design. This comparative computer simulation that was graphically recorded in FIGS. 10–11 were premised on the same operational and dimensional conditions other than the differing snout geometries. As indicated above, actual experimental performance tests confirmed the spot performance and high stability at full voltage when using the spherical gun holder configuration of the invention.

The spherical gun snout of this invention enables the closest possible spacing of the electron gun to the anode (target). The smaller the spacing, the shorter the working distance for the electron optics. A spherical shape produces the lowest possible surface field on the snout, thereby reducing field emission, even at very close working distances (high field) conditions. As to aperture size, it is important to contour the physical size of the electron lens with regard to the beam diameter. The larger the ratio, the more uniform the lens, resulting in fewer aberrations, and these concerns are important in the context of small spot x-ray sources. The aperture size of the snout is important to control the physical size of the electron lens with regard to the beam diameter. The larger the ratio, the more uniform the lens resulting in fewer aberrations. This is an important consideration in small spot x-ray sources.

Figure 3:
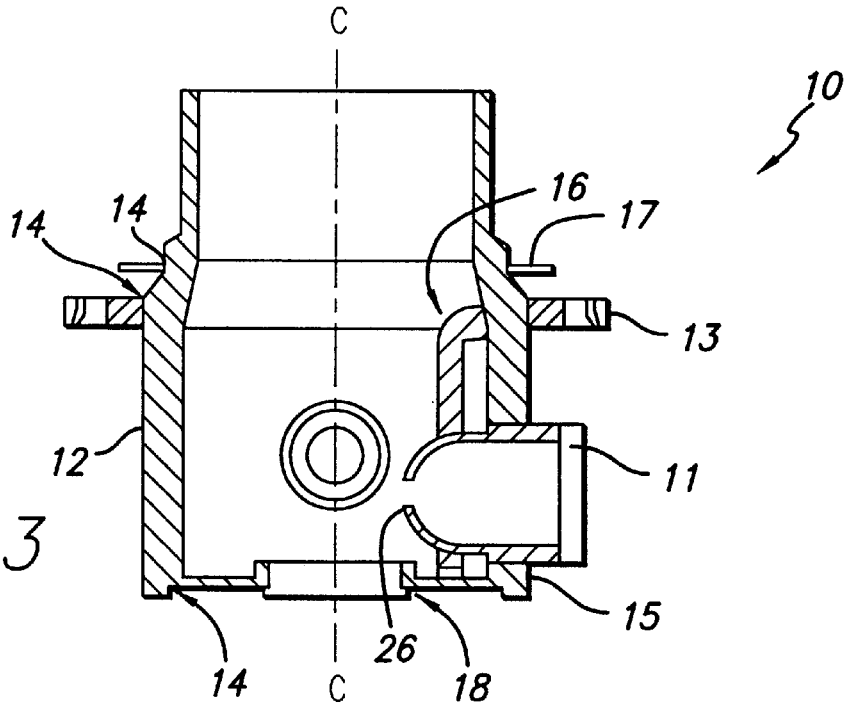
FIG. 3 is a sectional view of an x-ray tube of an embodiment of the invention during assembly of the body parts.
Figure 4:
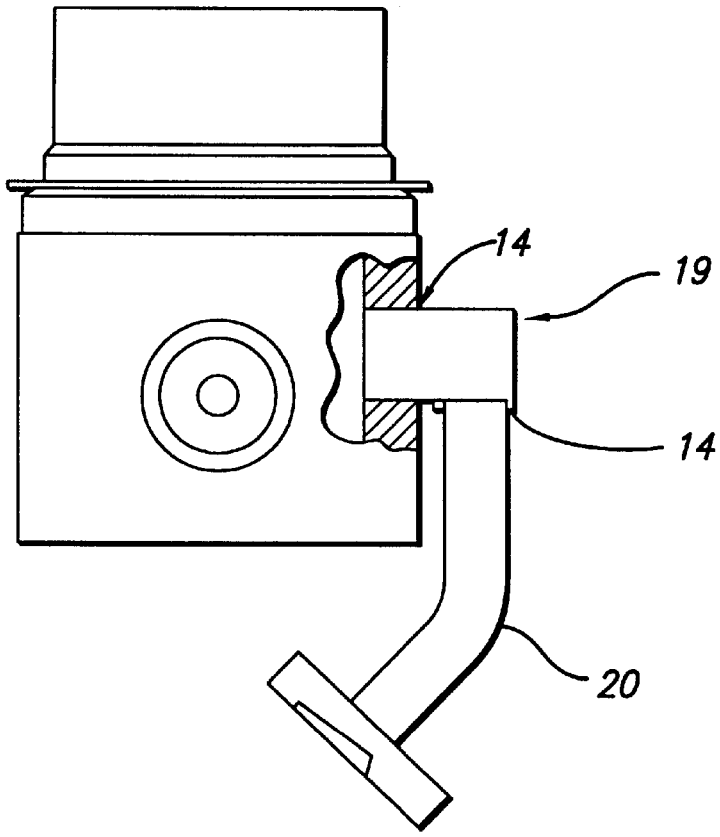
FIG. 4 is an exterior side view of the x-ray tube being assembled of FIG. 2, including a partial cut-away view of the mount of a vacuum line to the tube body.

Referring to FIGS. 3–8, the assembly of an x-ray tube 10 according to one embodiment of the invention is generally shown. In FIGS. 3–4, gun container (holder) 11 is placed in an envelope body 12. A tube flange 13 is assembled on body 12 with a plurality of counter sink holes facing the gun container 11. A braze wire 14 is inserted into flange 13. A braze sheet 15 is placed around a vacuum side of the gun container 11. A stigmator 16 is optionally placed over the braze sheet and held in place with a brazing fixture. A body weld ring 17 is placed on the envelope body 12, and a braze wire is placed around body 12 to seat the weld ring 17. A window adapter 18 is inserted into the envelope 12 with placement of brazing wire, and the entire assembly is mounted on a window brazing fixture (not shown). Then, a vacuum line to be used to evacuate the envelope is installed as shown in FIG. 4. In this regard, a tubulation elbow 19 is brazed to the envelope 12 using braze wire 14 around its circumference. The tube 20 is mounted in alignment with the centerline c—c of the envelope 12 and attached by brazing using braze wire 14.

Figure 5:
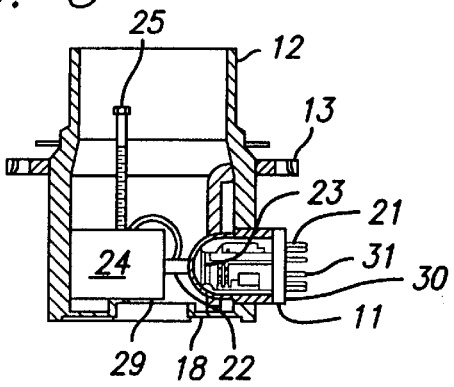
FIG. 5 is a sectional of an x-ray tube of an embodiment of the invention during assembly when the electron gun is mounted in the body.
Figure 6:
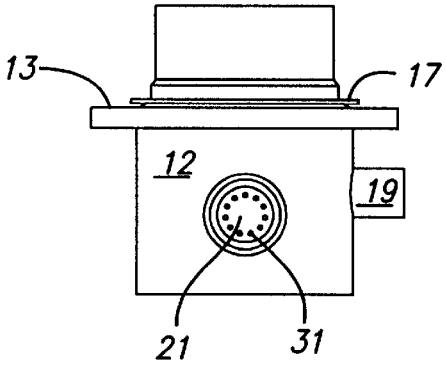
FIG. 6 is an an exterior side view of an x-ray tube of an embodiment of the invention during assembly when the electron gun is mounted in the body.

FIGS. 5–6 show the mounting of the electron gun assembly 21 in the envelope body 12. A temporary gun alignment pin 22 is inserted into a focus grid of accelerating electrodes $\mathbf{23}_1$–$\mathbf{23}_4$, e.g., four, that are part of the electron gun assembly 21. The electron gun assembly 21 includes a heater (e.g., a filamentary heater), a cathode, electrical power supply means (not shown), and the above-mentioned focus grid, which can be conventional in nature such as those described in U.S. Pat. No. 5,077,771 (Skillicorn), which teachings are incorporated herein by reference for all purposes. The gun locator alignment and support fixture 24 is placed inside body assembly 12 resting upon window adapter 18 and is temporarily fixed in place by screw pin 25. The gun assembly 21 and the alignment pin 22 are inserted into the gun container 11 such that the alignment pin 22 goes through the aperture 26 of the gun container 11 and rests flush and perpendicular against a confronting flat 29 of the gun alignment support 24. A header shield 30 is placed over header pins 31, and then the gun assembly 21 is TIG welded in place. The temporary gun locator fixture 24 is not removed yet.

Figure 7:
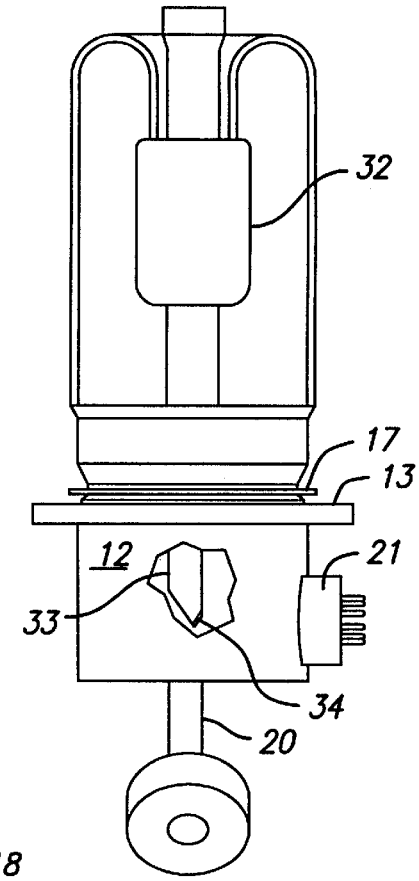
FIG. 7 is an exterior view of an x-ray tube of an embodiment of the invention during assembly when the target bulb assembly is mounted in the body, with a partial cut-away view provided to show the target assembly.
Figure 8:
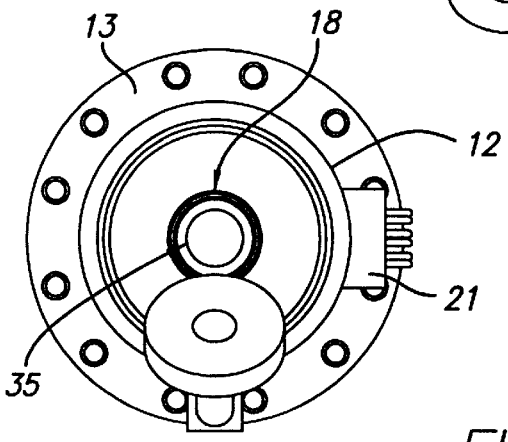
FIG. 8 is a bottom view of an x-ray tube of an embodiment of the invention during assembly when the x-ray window is mounted in the body.

As shown in FIGS. 7–8, a corona guard 32 is slid onto anode (target) assembly 33 and is screwed into place on the anode assembly. The target assembly has an anode 34 which faces the spherical snout 27 of the gun container 11. A target alignment structure is placed onto a target alignment support. The body assembly 12 is placed in the target alignment fixture such that the gun body 11 rests on the gun locator fixture 24 and the target locator fixture protrudes through the window hole of the body. The target bulb assembly is placed onto the body assembly 12, and the target bulb assembly is rotated such that the target assembly fits in the slot on the target locator with the target oriented as shown. The target bulb assembly is TIG welded to the body assembly 12 at weld ring 17. The window assembly, such as beryllium sheet, is then TIG welded to the body assembly 12 at window adapter 18.

Accordingly, by the present invention, an advanced re-entrant gun snout has been developed with a close working distance capable of achieving a highly focused spot, e.g., about 6 $\mu$m, which was well limited by chromatic aberration. The enhanced focusing achieved with the inventive x-ray tube is derived from the large final aperture, namely, with a filling factor of approximately 0.125, and the ability to use a shorter working distance between the electron gun and the anode (target). The filling factor equals the beam diameter at the aperture divided by the aperture diameter, d. The spherical gun holder affords focus quality while having lower surface fields than other snout geometries such as flat, conical or stepped. In addition, with the inventive gun, the highest field point is reduced to approximately 7700 V/m.

The present invention has been described herein with reference to a particular embodiment for a particular application. Those having ordinary skill in the art and access to the present teachings will recognize additional modifications could be made within the scope thereof.

It is therefore intended by the appended claims to cover any and all such applications, modifications and embodiments within the scope of the present invention.

Accordingly,

What is claimed is:

1. An x-ray tube comprising:

an electron gun assembly comprising an electron gun container housing an electron generator for generating electrons in a first direction along a first axis, wherein said gun container has a discharge end comprising a generally solid spherical shape and an egress aperture and a target for generating x-rays upon being impinged by the electrons.

2. An x-ray tube of claim 1 wherein said electron gun assembly contains a filamentary heater and a cathode, wherein the cathode emits electrons when heated by the heater, and said target is an anode.

3. An x-ray tube of claim 1 further comprising at least one accelerating electrode situated within the gun container at a location between the cathode and egress aperture of the discharge end of the gun container, wherein the at least one accelerating electrode includes an opening through which the electrons pass and accelerates said electrons emitted by said cathode and converges said electrons into an electron beam along said first axis.

4. An x-ray tube of claim 1 wherein said target is inclined at an angle to the first axis such that the x-rays emitted from the target proceed in a second direction along a second axis to a window, where the window comprises an x-ray transparent material.

5. An x-ray tube of claim 4 wherein the first and second directions are oriented substantially 90 degrees to each other.

6. An x-ray tube of claim 5 wherein said target has a face inclined at an angle of approximately 24 degrees relative to said second direction.

7. An x-ray tube of claim 4 wherein said window comprises a material selected from the group consisting of beryllium, aluminum, SST, titanium, glass, diamond, and plastic.

8. An x-ray tube of claim 4 wherein said window comprises a material selected from the group consisting of beryllium and aluminum.

9. An x-ray tube of claim 1 wherein said target has an exposed face comprises a material selected from the group consisting of tungsten, molybdenum and copper.

10. An x-ray tube of claim 1 further comprising an electrical power supply for said filamentary heater and said cathode.

11. An x-ray tube of claim 3 further comprising an electrical power supply for said at least one accelerating electrode.

12. An x-ray tube of claim 1 wherein said spherical surface has a concave side facing the cathode and a convex side facing the target.

13. An x-ray tube of claim 1 wherein said spherical surface comprises a dome shape.

14. An x-ray tube of claim 1 wherein said spherical surface comprises a substantially constant radius of curvature.

15. An x-ray tube of claim 1 wherein said spherical surface consists of a decreasing cross-sectional diameter in the direction of the electron beam.

16. An x-ray tube of claim 1 further comprising a sealed enclosure within which the electron gun assembly and the target are disposed.

17. An x-ray tube of claim 1 wherein said gun assembly is capable of forming an electron beam forming a focal spot on the target with a largest size being less than 10 microns.

18. An x-ray tube comprising:

an electron gun assembly comprising an electron gun container housing an electron generator for generating electrons in a first direction along a first axis, wherein said gun container has a discharge end comprising a solid spherical shape and an egress aperture;

a target for generating x-rays upon being impinged by the electrons;

an air evacuated enclosure within which the electron gun assembly and the target are housed and an x-ray transparent window through which generated x-rays can be emitted out of the housing.

19. An x-ray tube of claim 18 wherein said electron gun assembly being capable of forming an electron beam forming a focal spot on the target with a largest size being less than 10 microns.

20. An x-ray tube of claim 18 further comprising at least one accelerating electrode situated within the gun container at a location between the cathode and egress aperture of the discharge end of the gun container, wherein said at least one accelerating electrode includes an opening through which the electrons pass and accelerates said electrons emitted by said cathode and converges said electrons into an electron beam along said first axis.

* * * * *